US006604897B2

(12) United States Patent
Yeomans

(10) Patent No.: US 6,604,897 B2
(45) Date of Patent: Aug. 12, 2003

(54) VINYL SIDING TRANSPORT RACK AND METHOD OF CONSTRUCTION

(75) Inventor: Christopher L. Yeomans, Kearney, MO (US)

(73) Assignee: Variform, Inc., Kearney, MO (US)

( * ) Notice: Subject to any disclaimer, the term of this patent is extended or adjusted under 35 U.S.C. 154(b) by 0 days.

(21) Appl. No.: 09/949,422

(22) Filed: Sep. 7, 2001

(65) Prior Publication Data

US 2003/0049089 A1 Mar. 13, 2003

(51) Int. Cl.[7] ..... B60P 7/06; B65D 19/06

(52) U.S. Cl. ..... 410/32; 108/51.11; 211/191; 211/194; 414/608

(58) Field of Search ..... 410/31, 32; 108/51.11, 108/56.3, 57.3; 211/189, 191, 194; 206/598, 599; 414/608

(56) References Cited

U.S. PATENT DOCUMENTS

| | | | | | |
|---|---|---|---|---|---|
| 1,708,588 | A | * | 4/1929 | Proctor | 211/182 |
| 2,046,095 | A | * | 6/1936 | Shaw | 211/85.17 |
| 2,833,421 | A | * | 5/1958 | Skubic | 211/194 |
| 3,244,290 | A | * | 4/1966 | Kaufman et al. | 211/189 |
| 3,349,924 | A | * | 10/1967 | Maurer et al. | 211/41.1 |
| 3,741,417 | A | * | 6/1973 | Blankenship | 414/421 |
| 3,830,380 | A | * | 8/1974 | Spencer | 206/386 |
| 3,868,123 | A | * | 2/1975 | Berg et al. | 280/79.2 |
| 4,391,377 | A | * | 7/1983 | Ziaylek, Jr. | 211/85.18 |
| 4,433,883 | A | * | 2/1984 | Boender et al. | 312/234.1 |
| 4,588,096 | A | * | 5/1986 | Story et al. | 211/126.15 |
| 5,188,503 | A | * | 2/1993 | Appelberg | 414/748.1 |
| 5,924,577 | A | * | 7/1999 | Gessert | 211/41.1 |
| 6,135,299 | A | * | 10/2000 | Burgess | 211/194 |
| 6,464,092 | B1 | * | 10/2002 | Kortman et al. | 211/194 |
| 2001/0055523 | A1 | * | 12/2001 | Slodden et al. | 414/458 |
| 2003/0049089 | A1 | * | 3/2003 | Yeomans | 410/32 |

FOREIGN PATENT DOCUMENTS

| | | | | |
|---|---|---|---|---|
| DE | 3939483 A1 | * | 6/1991 | 206/599 |
| EP | 442237 A1 | * | 8/1991 | 211/126.1 |

* cited by examiner

*Primary Examiner*—D. Glenn Dayoan
*Assistant Examiner*—Paul Chenevert
(74) *Attorney, Agent, or Firm*—Lathrop & Gage LC

(57) ABSTRACT

Transport racks for shipment of a variety of objects are described. In accordance with one embodiment of the invention, transport racks are configured with vertical and horizontal support members. Cross-braces positioned atop the horizontal support members support partitions of a variety of configurations creating a plurality of longitudinally extending cells forming compartments for secure storage of the cargo. A panel is positioned atop the framework creating a covered storage area with a first and second open end. Netting and lattice gates positioned at the first and second open end secure the cargo, provide high visibility of the rack contents, and maximize ease of loading and unloading of the racks.

12 Claims, 3 Drawing Sheets

VINYL SIDING TRANSPORT RACK AND METHOD OF CONSTRUCTION

FIELD OF THE INVENTION

This invention relates generally to a transport rack, and more particularly to a rack that can be reused multiple times and because of its structural rigidity, protects its contents against damage. The invention has particular application to the transportation of vinyl siding. The rack provides a means by which goods which have been traditionally transported in wooden forms can now be containerized.

BACKGROUND OF THE INVENTION

Historically the transportation of goods by rail, road or water involved loading individual items and was labor intensive. The advent of the fork lift truck led to the introduction of palletized loads which avoided handling of individual items when transferring between different types of transport at freight terminals. Transport racks of the type, to which the present invention relates, are commonly used for shipping large volumes of materials.

It is a standard in the art to utilize transport racks that are fully sealed against the environment, having a top, sides and bottom that are welded and which have a door that can be securely sealed with a latch preventing entry of water and moisture laden air. In addition, those transport racks typically do not utilize any internal structure to support the cargo because of the wide array of cargo and dimensions that may be shipped in the crates. The present design is not sealed against the environment and utilizes multiple longitudinal cells for securing the cargo in position.

Industry and business now increasingly demand shipping containers with a long life-span that can be reused numerous times; moreover, optimization of space, weight and material is demanded. In addition, it should be possible to manufacture the transport racks in varying shapes and sizes to exact specifications of dimensions, weight and form. Moreover, the racks should also be easy to repair, clean and return for transport purposes.

In the vinyl siding industry, significant amounts of siding is produced in nominally 150 inch lengths and 10 inch widths. This particular size of siding is utilized in the manufactured housing market, therefore, the siding is shipped directly to the facility that produces the manufactured home and not to a distribution facility for retail consumption. In the past, vinyl siding of this size has required manufacturers to ship their product first protected in corrugated paper boxes and then multiple corrugated paper boxes are secured on wooden crates that are constructed at the siding manufacturing site, at great expense. The wooden crates are also only used once and then the wood is typically discarded.

It is estimated that in 2001 dollars, the cost of a corrugated paper box of the size used in the vinyl siding industry is approximately four dollars, and an average of twelve boxes are packed into a wooden crate. Furthermore, the cost of the wood, along with the labor in producing a wooden crate, and hidden costs, is approximately ninety dollars. When coupled with the price of corrugated paper, the cost of shipping a load of siding can rise to $150.00 per crate. The cost of producing the metal transport rack in 2001 dollars has been estimated to be approximately one-thousand dollars. An analysis of savings associated with elimination of the corrugated paper boxes and wooden crates suggests that once the metal transport rack has been used between seven and nine times, it has paid for itself in wood and labor savings. This return on investment analysis does not even consider the savings associated with reduction in damage arising from product shipped in the wooden crates which expose the siding and other cargo to puncture by the forks of a fork truck and being crushed under heavy loads that are inappropriately applied to the crates.

Therefore, a need exists for an improved container for shipping, and storing products, such as vinyl siding, that provides enhanced protection for the product, is reinforced to provide sufficient strength to withstand handling, shipping, and storage, and is designed for convenient storage when not in use, and can be reused numerous times. A need further exists for an improved shipping container that avoids damage through fork puncture and through crushing, which can be rapidly loaded and unloaded at either end and which is suited for multiple reuses.

It is accordingly an object of the present invention to provide a multi-purpose transport rack that provides adequate protection for elongated items, such a vinyl siding, stored and transported therein and to segregate the product into individual cells for simplified loading and removal of the product.

It is another object according of the present invention to provide a multi-purpose transport rack that is reinforced for improved strength characteristics.

It is a further object according to the present invention to provide a multi-purpose transport rack that is free of any sharp or rough internal surfaces so that items, such as vinyl siding, stored therein are not susceptible to damage. It is another object according to the present invention to provide a multi-purpose transport rack that is designed so that a plurality of such containers can be placed in a stacked configuration. It is yet another object according to the present invention to provide a multi-purpose transport rack that is capable of being placed in a nested configuration with other such containers for convenient storage.

BRIEF SUMMARY OF THE INVENTION

The present invention aims to provide a solution.

The present invention addresses the above-described problems of shipping cargo in transport racks standard in the art by providing a rack which can be reused multiple times, is structurally rigid thereby protecting the contents of the rack, which can be readily loaded or unloaded from either end and which can be stacked in a nested configuration for secure storage of the rack and its contents.

In one embodiment, a plurality of horizontal and vertical steel supports are integrally joined into a framework. Longitudinally disposed cross braces are positioned between the vertical support members and are positioned atop selected horizontal support members. The framework is configured to interlock with the framework of an adjacent rack wherein in a stacked configuration the framework is formed that is adapted to be received within the framework of an adjacent upper rack. The preferred embodiment of the rack utilizes a multitude of polypropylene partitions positioned atop the longitudinally extending cross braces to create longitudinally extending cells for placement of the cargo.

One embodiment of the partition is generally U-shaped with a single partition spanning the length of the longitudinally extending cell. The U-shaped partitions provide side protection for the cargo contents of the transport rack, however, this configuration limits viewing of the contents of the rack to determine whether the rack is empty, partially full or completely full. Another embodiment of the partition utilizes an inverted T-shape. The inverted T-shape partition eliminates the side panel protection of the rack contents, however, it does facilitate viewing of the rack contents. Another advantage of the inverted T-shaped configuration is that it utilizes less of the costly polypropylene material as there are two fewer T-shaped partitions required on each level than when U-shaped partitions are utilized.

To provide overhead protection to the cargo, a top panel of corrugated polypropylene plastic is attached using zip ties or some other commercially available attachment means. The top panel provides a covered storage area overlaying the longitudinal cells and the cargo contents. At each end of the longitudinal cells is an opening utilized for loading and unloading of the cargo. One approach to restraining the product from longitudinal movement incorporates a pair of gates hingedly mounted to the framework which can be rotated through approximately 180 degrees. The gates utilize vertical and horizontal ribs in a lattice fashion to restrain the cargo from shifting and yet also facilitate viewing of the transport rack contents. In addition to the lattice gates, a flexible mesh akin to a tailgate of a pick-up truck may be utilized. The mesh configuration of the gate offers the advantage of not requiring a wide swing area and is less susceptible to damage as compared to the hinged gate when in the open position. The gate can be secured to the framework using snaps, plastic ties, rope, bungi cords or any other suitable means of attachment.

The transport rack framework is configured to interlock with the framework of an adjacent upper rack when in a stacked configuration. More specifically, the framework corner vertical support members rise to a steel nipple that are received within the framework recesses of an adjacent rack loaded atop the first rack.

DETAILED DESCRIPTION OF THE INVENTION

Figure 1:
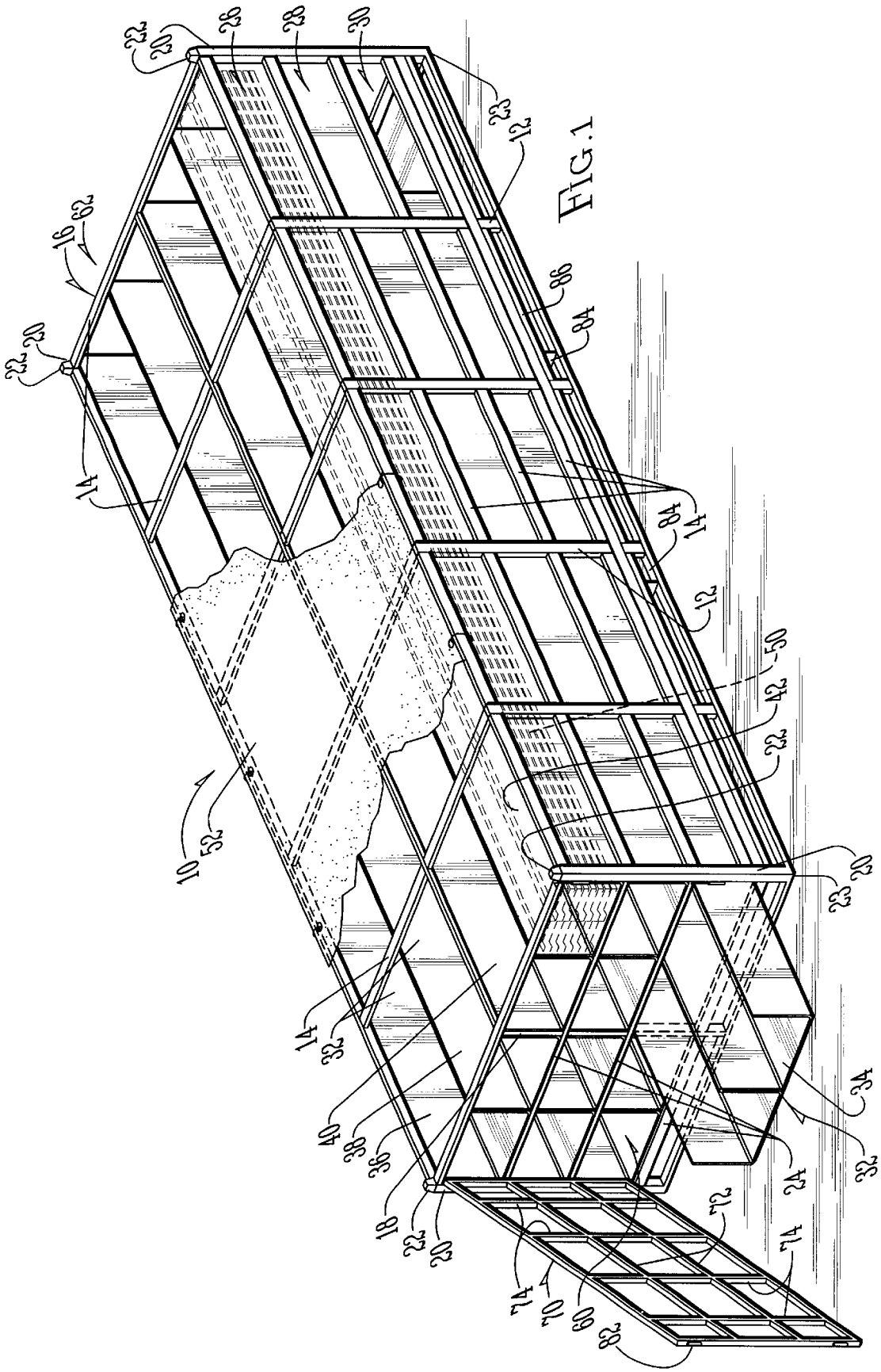
FIG. 1 is a perspective view of the transport rack of the present invention.
Figures 5, 6:
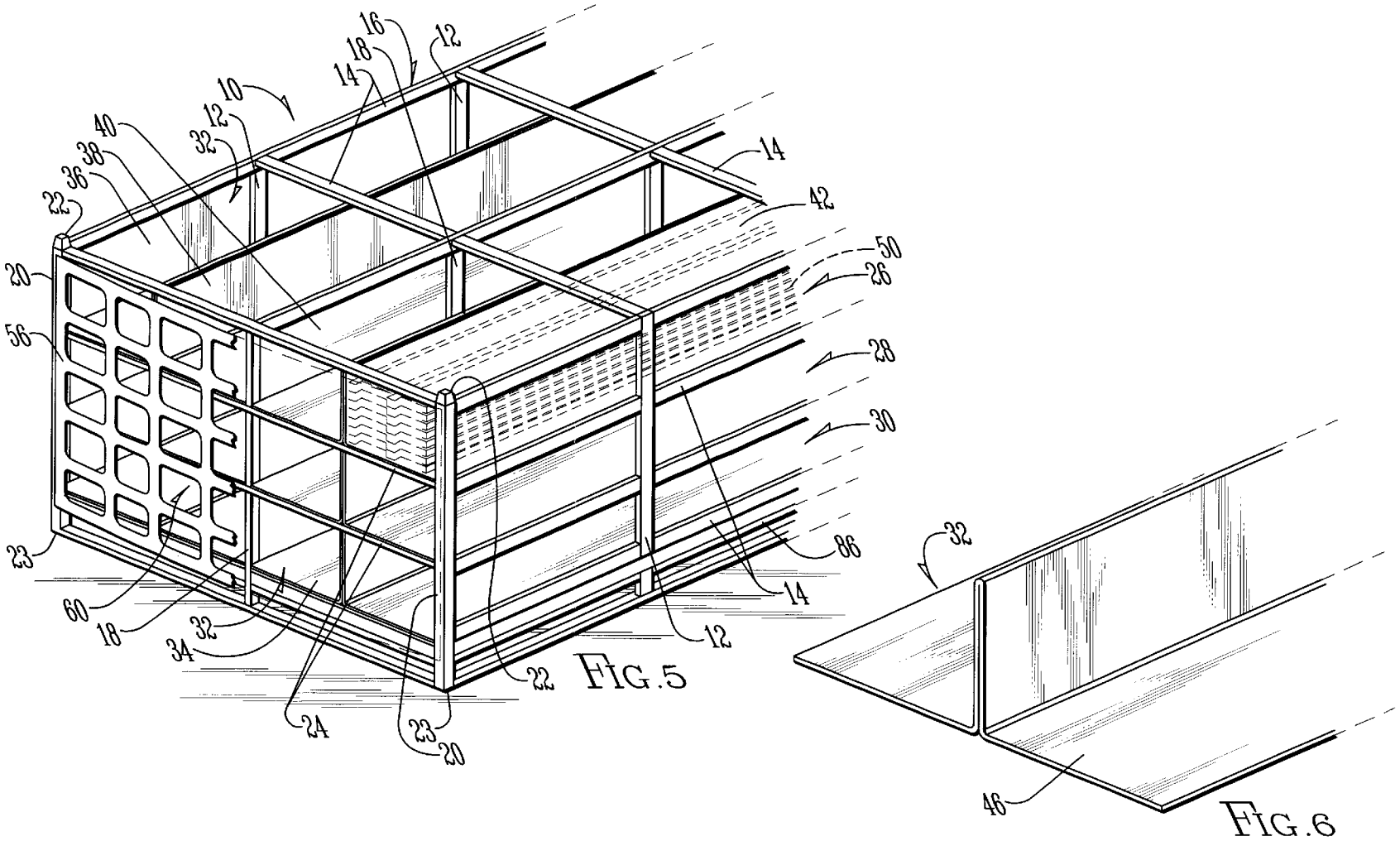
FIG. 5 is fragmentary perspective view of a single longitudinally extending cell loaded with vinyl siding product and a fragmentary perspective view of a flexible mesh gate secured in position.
FIG. 6 is a perspective view of an inverted T-shaped partition.

FIGS. 1 and 5 are perspective illustrations of two embodiment of a transport rack of the present invention. The transport rack 10 includes a plurality of externally disposed vertical support members 12 and horizontal support members 14 integrally joined into a framework 16. The framework 16 forms a box shaped container that is preferably generally rectangular in dimension from a top view and generally rectangular in dimension when viewing from the front, rear and sides. Each side of the preferred embodiment of the transport rack 10 utilizes between four and seven vertical support members 12. In addition, there are between four and seven vertical support members 18 disposed midway between the externally disposed vertical support members 12 providing additional structural support to the transport rack.

The externally disposed vertical support members 12 located on the sides of the transport rack 10 and midway support members 18 are typically two inch square steel tubes with a tube thickness of one-quarter of an inch. The members 12, 18 are nominally fifty inches in height with the four vertical support members located at the corners 20 of the rack 10 having a steel nipple 22 located at the apex of the member. The nipples 22 of the four corner vertical support members 12 are received within the framework of an adjacent upper rack when the racks 10 are placed in a stacked configuration. The four nipples 22 of the lower rack fit within the openings 23 at the bottom of the four corner vertical support members 12 of the upper rack. The nipples 22 of the lower rack are inserted approximately one to two inches into the upper rack vertical members and serve to lock the upper rack into position atop the lower rack.

In addition to the vertical members 12, 18 and horizontal support members 14 forming the framework 16, longitudinally disposed cross-braces 24 are positioned atop all but the uppermost horizontal support members 14. The cross-braces 24 are preferably manufactured from steel plating and welded into position onto the horizontal support members 14. The cross-braces 24 are nominally six inches in width and of at least one-quarter inch thickness. A total of twelve cross-braces 24, four on each of the three levels 26, 28, 30, span the entire length of the rack 10 providing support for the finished product. The cross-braces 24 are critical in that they prevent sagging of the finished product such as vinyl siding which lacks resistance to bowing because of its thin cross-section. Vinyl siding is particularly prone to bowing if not fully supported along the entire length, particularly on hot days when the polyvinyl chloride softens and increases in flexibility. If vinyl siding bows and is not straightened before cooling it will become a damaged and unuseable product because internal stresses will form in the product which cannot be eliminated, such bowing will adversely affect its aesthetic appeal.

As discussed above, a total of four cross-braces 24 are positioned on each of the three levels 26, 28, 30 of the rack 10. The four cross-braces 24 also provide support for a plurality of removably securable partitions 32 positioned atop the cross-brace 24. The cargo receiving removably securable partitions 32 are preferably constructed of polypropylene corrugated plastic of at least four millimeter thickness. The four millimeter thickness of corrugated plastic is capable of supporting two-hundred pounds per square foot of corrugated plastic without crushing the corrugation and is considered the minimum thickness acceptable for this application. The partitions 32 are nominally 150 inches in length, nominally eleven inches in width and nominally thirteen inches in height.

Figure 4:
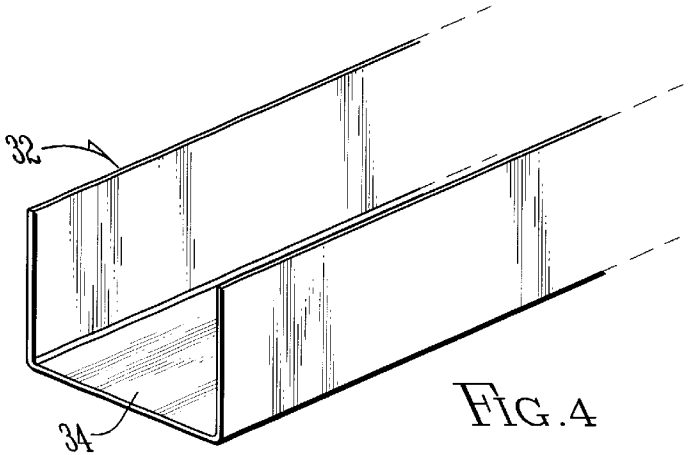
FIG. 4 is a perspective view of a generally U-shaped partition.
Figure 3:
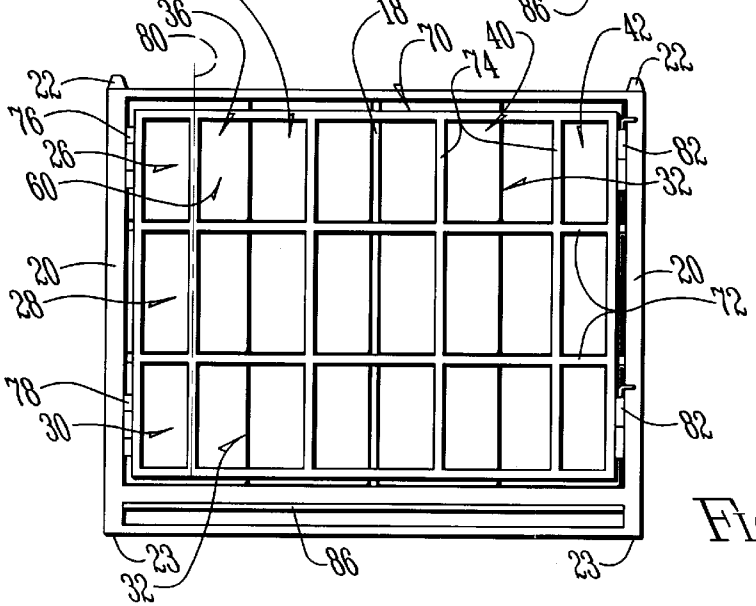
FIG. 3 is an end view of the transport rack depicting the hinged lattice gate in a closed configuration.

Two distinct embodiments of the partitions 32 are applicable to this invention. As depicted in FIG. 4, the first embodiment of the partition 32 is generally U-shaped 34. When the generally U-shaped partition 34 is in place the cargo is protected against damage from all but the most forceful of impacts. At the same time, the generally U-shaped embodiment of the partition 34 prevents an observer of the side of the rack 10 from determining whether the rack is full, partially full, or contains no product at all. With the generally U-shaped partition 34, a total of four separate partitions are required to span the rack 10 from side-to-side creating a total of four longitudinally extending cells 36, 38, 40, 42 for placement of cargo. This configuration of longitudinally extending cells is repeated on at least two additional levels of the rack 10. The nominally six inch wide cross braces 24 are centrally disposed within each of the longitudinally extending cells 36, 38, 40, 42 that also appear on at least two additional levels of the transport rack. The cross braces 24, as previously discussed, support the partitions 32 along the entire length of the rack and need not be as wide as the partitions to provide adequate support. The nominally six inch wide cross braces 24 reduce cost and weight when compared to wider cross braces.

As shown in FIG. 6, an alternative embodiment of the partition 32 is an inverted T-shape partition 46. The inverted T-shape partition 46 does not provide side impact protection for the cargo, however, it does allow an observer to determine whether the rack 10 is full, partially full, or empty. In addition, the inverted T-shape partition 46 utilizes less corrugated plastic material than the generally U-shaped partition 34 and it is therefore less costly to fully equip the rack 10 for shipping service. The T-shaped partition 46 because it would typically span two of the four cells 36, 38, 40 and 42 is nominally twenty-three inches in width, however, other partition dimensions could also be utilized depending upon the dimension of products being shipped.

Both partition configurations 34, 46 serve to separate vinyl siding stacks 50, or other products, which may be stacked fifty units high per longitudinally extending cell 36, 38, 40, 42. The vinyl siding stacks 50 according to the present invention is not placed in corrugated paper boxes in order to save the expense of the corrugated paper, therefore, restrains of some fashion, such as with the partitions, should be used to prevent the product from becoming disarrayed in the longitudinally extending cells by shifting as the rack 10 experiences the typical vibrations associated with transport.

Positioned atop the transport rack 10 is a removable top panel 52 to provide topside protection to the vinyl siding stacks 50, or other cargo. The top panel 52 may be constructed of metal, wood, fiberglass or rubber and is preferably constructed of polypropylene corrugated plastic of at least four millimeter thickness and is attached to the framework 16 with plastic ties, rubber bungi cords, rope, snaps or any other suitable attachment means.

The transport rack 10, as discussed above, is comprised of three levels 26, 28, 30 of four longitudinally extending cells 36, 38, 40, 42 yielding a total of twelve cells on the three levels. The vinyl siding that would typically be loaded into the transport rack is 150 inches in length and this dimension of siding is utilized by companies that produce manufactured homes. The home production facility seeks access to the vinyl siding from either end of the transport rack 10, therefore, means to facilitate that access is critical. Consequently, as depicted in FIG. 5, to maximize ready access to the contents of the transport rack 10, a flexible mesh end closure 56 is attached to the framework 16 and covers the opposed open ends 60, 62 of the transport rack. The flexible mesh may be secured to the framework with plastic ties, snaps or rubber straps among other attachment means. Flexible mesh 56 comparable to that commonly utilized on pickup truck tailgates would be a preferred solution. The flexible mesh offers the advantage of not requiring a wide swing area as with a rigid gate. Once the twelve longitudinally extending cells of the rack 10 are fully loaded with the stacks of siding 50, flexible mesh 56 is positioned over the openings to secure the siding, or other cargo, in place. When the flexible mesh 56 is secured over the openings the mesh 56 is in transport position.

An alternative embodiment for securing the first and second mutually opposed ends 60, 62 of the rack 10 is a gate or end closure 70 that is pivotally attached to the framework 16. The gate 70, configured with both horizontal ribs 72 and vertical ribs 74 is attached to the framework 16 by at least two hinges 76, 78. The vertical ribs 74 are positioned to coincide with the centerline 80 of the longitudinally extending cells 36, 38, 40, 42, and to obstruct the longitudinal movement of the siding 50. The horizontal ribs 72 are positioned to coincide with the cross-braces 24 on all three levels of the transport rack 10. The horizontal ribs 72 and vertical ribs 74 are constructed of square steel tubes with side dimensions of at least one inch. The gate 70 is capable of pivoting through approximately 180 degrees from closed to fully open and can be secured in position by means of a latch 82 or any other suitable means for securing the gate.

Figure 2:
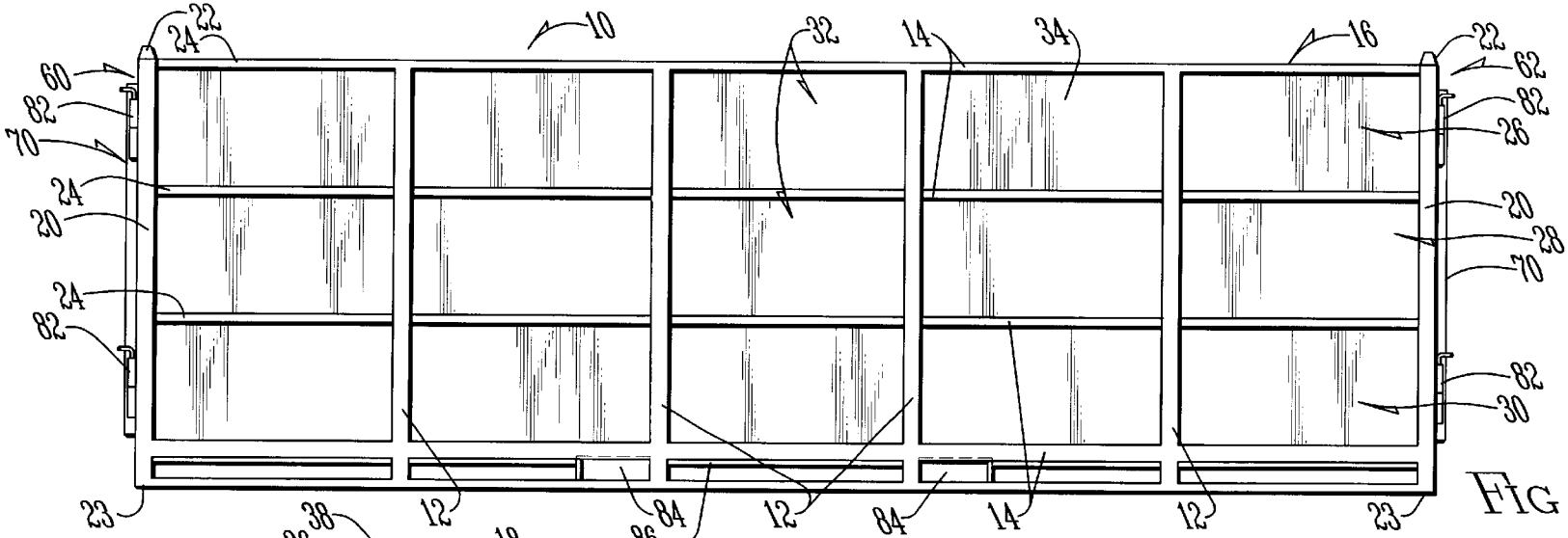
FIG. 2 is a side view of the transport rack's vertical support members, horizontal cross-braces, and fork lift entry guides.

To facilitate movement of the cargo, as depicted in FIG. 2, the transport rack 10 is equipped with fork guides 84 for a fork lift truck. The fork guides 84 are centrally located on the sides of the transport rack. Positioned immediately above the fork guides 84 in the framework 16 is a steel plate 86 of at least three-eighths inch thick steel to protect the contents of the transport rack against damage from the forks of the fork truck. The steel plate 86 spans the transport rack from side-to-side and from one fork guide 84 to the other 84.

The above described transport racks can be utilized to ship a wide array of products. For example, the racks may haul vinyl siding, carpeting, automobile bumpers, elongated specialty products, and decorative trim to name just a few. The above described embodiments are exemplary and are not meant to be limiting.

What is claimed is:

1. A transport rack for material transport comprising:

a box shaped container presenting first and second mutually opposed open ends;

a plurality of longitudinally disposed cells extending between said open ends in said container;

a plurality of elongated cargo receiving partitions configured to be removably received by said cells, wherein the partition cross section shape is an inverted T shape; and end closures associated with said first and second end openings operable between cargo loading/unloading and cargo transport positions.

2. The transport rack of claim 1, wherein the elongated cargo receiving partitions are comprised of polypropylene and are at least 4 millimeters thick.

3. A transport rack for material transport comprising;

a plurality of vertical and horizontal support members integrally joined in a framework;

the framework configured to interlock with the framework of an adjacent rack disposed above and below to form a stacked configuration;

a plurality of longitudinally disposed cross-braces disposed between the vertical support members and positioned atop selected horizontal support members;

a removably securable panel disposed atop the framework defining a covered storage area, the covered storage area having a first and second open end;

removably securable restraining members disposed at the first and second open ends of the covered storage area to restrain movement of the cargo; and a plurality of removably securable partitions positioned atop the longitudinally disposed cross braces within the framework forming a plurality of longitudinally extending cells, wherein the partition cross section shape is selected from the group consisting of substantially a U-shape and substantially an inverted T shape in cross section.

4. The transport rack of claim 3, wherein the securable partitions are comprised of polypropylene and are at least 4 millimeters thick.

5. The transport rack of claim 3, wherein the plurality of longitudinally extending cells extend the length of the transport rack.

6. The transport rack of claim 3, wherein the top panel is comprised of at least one of plastic, metal, wood, fiberglass and rubber.

7. The transport rack of claim 3, wherein the framework further comprises a fork guide to permit entrance of the fork of a forklift truck.

8. The transport rack of claim 7, wherein disposed above the fork guide is a steel panel.

9. The transport rack of claim 8, wherein the steel panel is at least three-eighths inch thick.

10. The transport rack of claim 3, wherein the removably securable restraining members are comprised of mesh.

11. The transport rack of claim 3, wherein the restraining members are removably secured to the framework with at least one of plastic ties, snaps and rubber straps.

12. A transport rack for bulk shipment of cargo comprising;

a plurality of vertical and horizontal support members integrally joined in a framework;

the framework configured to interlock with the framework of an adjacent rack wherein in a stacked configuration the framework is adapted to be received within the framework of an adjacent upper rack;

a plurality of longitudinally disposed cross-braces disposed between the vertical support members and positioned atop selected horizontal support members;

a removably securable panel disposed atop the framework defining a covered storage area, the covered storage area having a first and second open end;

a plurality of removably securable partitions positioned atop the longitudinally disposed cross-braces within the framework forming a plurality of longitudinally extending cells; and a pair of opposed gates, for securing the cargo in the storage area, pivotally connected to the framework at the first and second open ends by at least two hinges, wherein the gates are comprised of horizontal and vertical ribs, the vertical ribs being aligned with the vertical centerline of the longitudinally extending cells to provide interference with the cargo thereby preventing cargo loss, the gates being rotatable about 180 degrees from a fully closed to a fully open position.

* * * * *